United States Patent [19]

Flores

[11] 4,161,043

[45] Jul. 17, 1979

[54] SEALING MECHANISM FOR A LIQUID FLOOR DRAIN

[76] Inventor: Raymond Flores, P.O. Box 226, Union City, Calif. 94587

[21] Appl. No.: 885,653

[22] Filed: Mar. 13, 1978

[51] Int. Cl.[2] ..... E03C 1/26; E03F 5/06; F16L 17/02

[52] U.S. Cl. ..... 4/292; 285/59; 285/339; 277/205

[58] Field of Search ..... 285/56–60, 285/339; 4/252 R, 286, 288, 289, 290, 291, 292; 277/205, 212 R, 212 C

[56] References Cited

U.S. PATENT DOCUMENTS

| | | | |
|---|---|---|---|
| 795,976 | 8/1905 | Herrick | 285/339 |
| 990,646 | 4/1911 | Fisher | 285/56 |
| 2,924,472 | 2/1960 | Bush | 285/110 X |
| 2,935,349 | 5/1960 | Burch | 285/110 X |
| 3,742,525 | 7/1973 | Oropallo | 4/292 X |
| 3,745,594 | 7/1973 | Cosper | 4/292 |
| 3,807,744 | 4/1974 | Gibling | 285/58 X |

FOREIGN PATENT DOCUMENTS

| | | | |
|---|---|---|---|
| 2430248 | 1/1976 | Fed. Rep. of Germany | 285/339 |
| 408565 | 9/1966 | Switzerland | 285/339 |

*Primary Examiner*—Robert S. Ward, Jr.
*Attorney, Agent, or Firm*—Bielen and Peterson

[57] ABSTRACT

A sealing mechanism for a floor drain where an opening in the floor is located in the vicinity of a liquid drain conduit beneath the floor. The mechanism uses a connecting conduit which communicates with the drain conduit beneath the floor and includes a first gasket member which fits within the opening and around the connecting conduit. The first gasket member has a wall circumjacently spaced from the conduit and connected to an endless loop also circumjacently placed with respect to the connecting conduit. A second gasket member is sized for circumjacent placement with respect to the connecting conduit and includes wedging means for forcing the first wall of the first gasket member against the side portions of the drain opening to effect sealing between the conduit and the side portions of the drain opening.

8 Claims, 3 Drawing Figures

SEALING MECHANISM FOR A LIQUID FLOOR DRAIN

BACKGROUND OF THE INVENTION

It is a continuing problem to direct liquid such as water from a floor into a drain conduit located below the floor without leakage therebetween. This is especially acute in showers and bathtubs, where water is present in relatively great amounts.

In the past, it was required to apply sealing compounds, oakum, and molten lead to effect a sealing. In addition, nuts and washers of various sizes were required to retain the seal. It should be noted that U.S. Pat. No. 3,668,718 described an improvement to the traditional method of caulking drains. It employed a specially designed gasket where a threaded member received a nut which bears on the upper end of a gasket to urge the same and to sealing engagement between the pipe and drain member. Although the drain connection shown in this patent was an improvement, the work required to install such a drain connection necessitated the use of skilled personnel. A need exists for a simple and easily installed drain sealing mechanism which may be utilized by unskilled personnel and perform the task of preventing liquid leakage as well as any prior drain sealing systems.

SUMMARY OF THE INVENTION

In accordance with the present invention a novel sealing mechanism for a liquid floor drain is provided. The mechanism includes the use of a connecting conduit with a floor drain having a floor opening or receptor located above a liquid drain conduit. The connecting conduit communicates with the drain conduit and extends upwardly to the vicinity of the floor.

A first gasket member is sized to fit within the floor opening and around the connecting conduit which is located within the floor opening also. The first gasket member has a first portion which has as one of its elements a first wall spaced circumjacently with respect to the connecting conduit. In addition, the first portion also has an endless loop connected to the first wall and which is circumjacently placed with respect to the connecting conduit.

A second gasket member is likewise sized for circumjacent placement with respect to the connecting conduit and interposes the same as the first wall of the first gasket member. The second member includes wedging means for forcing first wall of the first member against the side portions of the drain opening. This wedging means affects sealing between the connecting conduit and the side portions of the drain opening.

The first gasket member may further include a second wall circumjacently positioned with respect to the connecting conduit. The second gasket member would then interpose the first and second walls of the first member. The second wall of the first gasket member may be connected to the endless loop to form a cavity between the first and second walls of the first gasket member. The second gasket member would then fit within this cavity and wedging means would spread the first and second walls of first gasket member to affect the sealing heretofore described.

The wedging means may take several forms such as forming the second gasket member with a downwardly tapered cross-sectional configuration. Thus, squeezing the second gasket member within the cavity formed between the first and second walls of the first gasket member would cause the spreading of these walls.

The second gasket member may also include means for overlapping the upper edge portions of the first and second walls of the first member, ie: the edge portions oriented toward the floor. Such means may take the form of a cap which provides the second gasket member with a T-shaped cross-sectional configuration on its upper portion. Stop means may be included for limiting the travel of the first and second gasket members in relation to the circumjacent connecting conduit. By this provision, the gasket members would be positioned just below the floor to permit the installation of a conventional strainer. Such stop means may take the form of a platform located on the side portions of the floor opening.

It may be apparent that a new and useful drain sealing mechanism has been described and it is therefore an object of the present invention to provide a drain sealing mechanism which easily and efficiently prevents leakage of fluid flowing from a floor to a liquid drain conduit therebelow.

It is another object of the present invention to provide a drain sealing mechanism which eliminates the use of conventional caulking materials and skilled personnel to install the same.

It is yet another object of the present invention to provide a drain sealing mechanism which may be employed in conjunction with non-metallic piping.

It is another object of the present invention to provide a drain sealing mechanism compatible with preformed shower floors.

It is still another object of the present invention to provide a drain sealing mechanism which employs first and second gasket members which may be wedged into sealing configuration by conventional methods and provide a tight seal merely by the application of a force.

The invention possesses other objects and advantages especially as concerns particular features and characteristics thereof, which will become apparent as the specification continues.

Various aspects of the present invention will evolve from the following detailed description of the preferred embodiments thereof which should be taken in conjunction with the accompanying drawings.

DESCRIPTION OF THE PREFERRED EMBODIMENTS

Figure 1:
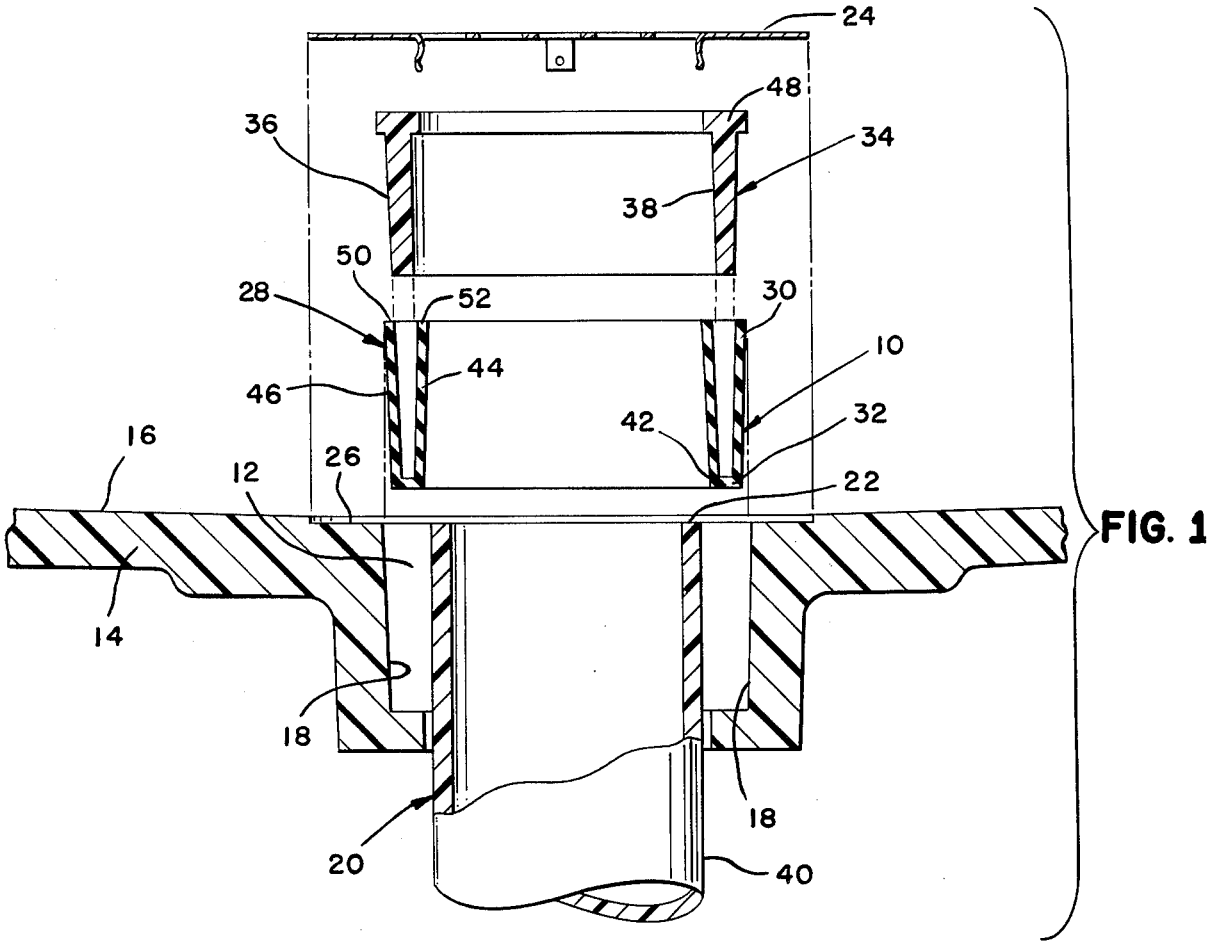
FIG. 1 is an exploded sectional view of the mechanism of the present invention.
Figure 2:
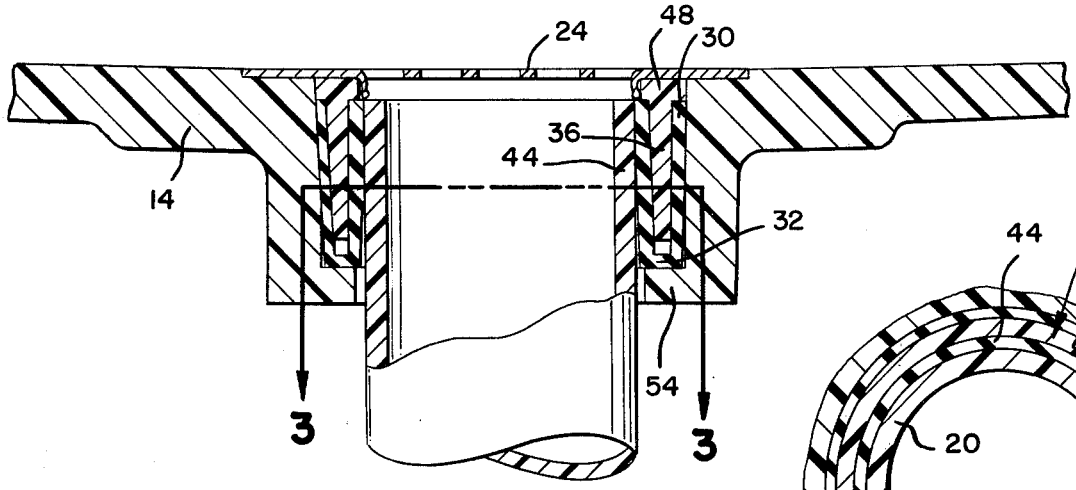
FIG. 2 is a sectional view of the mechanism of the present invention in place.
Figure 3:
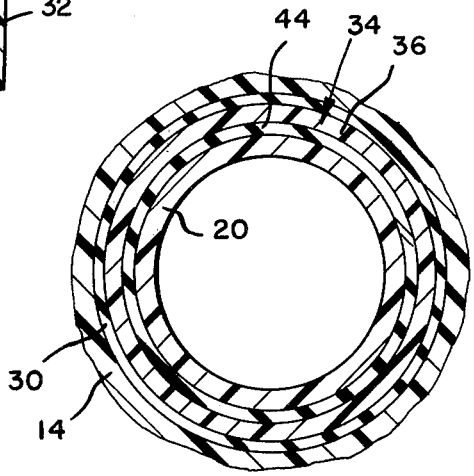
FIG. 3 is a broken sectional view taken along line 3——3 of FIG. 2.

The mechanism as a whole is shown in the Figures by reference character 10. The mechanism may be used with opening 12 of floor 14 which has an upper surface 16. In a shower environment floor 14 is waterproof such that water originating in the shower head travels along surface 16 and through opening 12. Below opening 12 would be located a liquid drain conduit (not shown) constructed in the conventional manner. Opening 12 includes side portions 18 which is illustrated in FIG. 1–3 as being circular in cross-sectional configuration. Floor 14 may be pre-formed by molding plastic-like material.

Sealing mechanism 10 has as one of its elements a connecting conduit 20 which generally follows the shape of sides of opening 18. Conduit 20 may be constructed of metallic material but is shown in the preferred embodiment as being pre-formed of plastic material, FIG. 1. Connecting conduit communicates with the drain conduit below floor 14 such that any water entering the upper portion of connecting conduit 20 would flow into the drain conduit heretofore described. It should be noted that the upper edge 22 extends to a desired distance below the upper surface 16 of floor 14. This permits the installation of strainer 24 within the recess 26 without interference from connecting conduit 20. The strainer 24 may be constructed of stainless steel, plastic, plated metallic material and the like.

First gasket member 28 is sized for placement within floor opening 12. In general, first gasket member 28 places circumferentially with respect to connecting conduit 20. First gasket member 28 includes a first wall 30 spaced from connecting conduit 20, FIG. 2. In addition first gasket member also has endless loop 32 connected to first wall 30. Endless loop 32 circumjacently positions with respect to connecting conduit 20.

Second gasket member 34 is sized for circumjacent placement with respect to first gasket member 28. Second gasket member 34 includes wedging means 36 for forcing first wall 30 of first gasket member 28 against side portions 18 of opening 12. At the same time, the inner surface 38 of second gasket member 34 would move into sealing engagement with the outer surface 40 of connecting conduit 20. Movement of first wall 30 toward side portions 18 of opening 12 tends to move the inside surface 42 of endless loop 32 toward surface 40 of connecting conduit 20, also. Thus, sealing of the space between connecting conduit 20 and side portions 18 of drain opening is effected.

The first gasket member may also take the form which embraces a second wall 44 circumjacently positioned with respect to connecting conduit 20 and spaced from first wall 30 of first gasket member 28. Second wall 44 connects to endless loop 32 to form a cavity 46 spanning first and second walls 30 and 44 of first gasket member 28.

In this case, second gasket member 34 snuggly fits within cavity 46. Wedging means 36 may take the form of a tapered cross-sectional configuration of second gasket member 34. Movement of second gasket member 34 into cavity 46 spreads walls 30 and 44 to seal the space between sides 18 and connecting conduit, FIG. 2. Further, second gasket member 34 may include means 48 for overlapping the upper edge portions 50 and 52 of walls 30 and 44. Means 48 tends to prevent liquid from entering cavity 46 and working deleterious effects on endless loop 32.

Stop means 54 limits the travel of first and second gasket members which results in accurate positioning of the same below upper surface 16 of floor 14. As shown in FIGS. 1 and 2, stop means 54 may take the form of a platform connected to the side portions 18 of opening 12. Stop means 54 may be obviously molded into floor 14 ab initio.

Gasket members 28 and 34 may be formed of elastomeric materials such as neoprene, silicone, rubber, and the like. However, first and second gasket members 28 and 34 are not deemed to be limited to these materials in any manner.

In operation, the user inserts connecting conduit 20 within opening 12 and connects the same to a drain conduit below floor 14. Connecting conduit 20 is sized to rise to a point below recess 26. First gasket member 28 is slipped over conduit 20 and limited by the action of stop means 54. Second gasket member 34 is fitted within cavity 46 and forced downwardly as far as it will travel. Wedging means 36 spreads first and second walls 30 and 44 to affect sealing between conduit 20 and side portion 18 of opening 12. Means 48 caps cavity 46. Strainer 24 is placed within recess 26 in the conventional manner. Liquids on the upper surface 16 of floor 14 flow through conduit 20 without leakage between floor 14 and conduit 20.

While in the foregoing specification embodiments of the invention have been set forth in considerable detail for the purposes of making a complete disclosure of the invention, it will be apparent to those of ordinary skill in the art that numerous changes may be made in such details without departing from the spirit and principals of the invention.

What is claimed is:

1. A sealing mechanism for a liquid floor drain having a floor opening including side portions in the vicinity of a liquid drain conduit comprising:

a. a connecting conduit adapted for communicating with the liquid drain conduit and extending therefrom within the floor opening to the vicinity of the surface of the floor;

b. first gasket member adapted for placement within the floor opening and for placement circumferentially with respect to said connecting conduit, said first gasket member having a first wall adjacent said connecting conduit, said first gasket member also having a second wall circumjacently positioned with respect to said connecting conduit and adjacent first wall, said first and second walls of said first gasket member each having edge portions oriented toward the floor, said first and second walls forming a cavity therebetween;

c. second gasket member being circumjacently placed with respect to said first gasket member, said second gasket member including wedging means for forcing said first wall of said first gasket member against the side portions of said drain opening, and for forcing said second wall of said first gasket member against said connecting conduit, said second gasket member effecting sealing between said connecting conduit and the side portions of said drain opening; and d. means for overlapping said edge portions of said first and second walls and for sealing said cavity formed therebetween.

2. The mechanism of claim 1 in which said first gasket member also includes an endless loop connected to said first wall and circumjacently placed with respect to said connecting conduit.

3. The mechanism of claim 2 in which said second wall of said first gasket member connects to said endless loop and second wall to form a cavity between said first and second walls of said first gasket member.

4. The mechanism of claim 3 in which said second gasket member snuggly fits within said cavity and said wedging means spreads said spaced first and second walls to effect sealing between the sides of the drain opening and the connecting conduit.

5. The mechanism of claims 1, 3, or 4, in which said wedging means comprises forming said gasket member with a tapered cross-sectional configuration.

6. The mechanism of claim 5 which additionally comprises stop means for limiting the travel of said first and second gasket members in relation to said circumjacent connecting conduit.

7. The mechanism of claim 6 in which said stop means comprises a platform connected to the side portions of the floor opening.

8. The mechanism of claim 6 in which said first and second gasket members are composed of elastomeric material.

* * * * *